US005107183A

United States Patent [19]

Yamamoto et al.

[11] Patent Number: 5,107,183

[45] Date of Patent: Apr. 21, 1992

[54] DISCHARGING METHOD AND SMALL FLUORESCENT LAMP USING THE DISCHARGING METHOD

[75] Inventors: Hitoshi Yamamoto; Sadahiro Yanai, both of Tokyo, Japan

[73] Assignee: Minipilo Electric Co., Ltd., Tokyo, Japan

[21] Appl. No.: 586,950

[22] Filed: Sep. 24, 1990

[30] Foreign Application Priority Data

Oct. 16, 1989 [JP] Japan ..... 1-268693
Oct. 30, 1989 [JP] Japan ..... 1-127003[U]
Jul. 27, 1990 [JP] Japan ..... 2-200852

[51] Int. Cl.[5] ..... H05B 41/14; H01J 17/34

[52] U.S. Cl. ..... 315/209 R; 315/71; 315/94; 315/101; 315/DIG. 1; 315/330; 315/335; 313/631; 313/632

[58] Field of Search ..... 315/209 R, 94, 98, 101, 315/64, 69, 71, DIG. 1, DIG. 5, 330, 335; 313/549, 576, 581, 591, 592, 593, 595, 306, 307, 553, 558, 631, 632, 619

[56] References Cited

U.S. PATENT DOCUMENTS 3,611,024 10/1971 Nakatsu et al. ..... 315/335 X
4,739,227 4/1988 Anderson ..... 315/DIG. 1 X
4,902,933 2/1990 Roberts ..... 315/94

*Primary Examiner*—Eugene R. LaRoche
*Assistant Examiner*—Ali Neyzari
*Attorney, Agent, or Firm*—Notaro & Michalos

[57] ABSTRACT

A charging method within a glass tube using a direct current of low voltage is provided in order to obtain a small fluorescent lamp with a light emission of high luminance. Two distinct discharges are achieved through use of one negative electrode. The filament-like negative electrode is arranged at a short spaced relation to a positive electrode at one end of the glass tube and upon application of the direct current voltage becomes the preliminary discharge. A second positive electrode is positioned at the opposite end of the glass tube and has a greater-spaced relation to the negative electrode resulting in the second discharge.

12 Claims, 7 Drawing Sheets

DISCHARGING METHOD AND SMALL FLUORESCENT LAMP USING THE DISCHARGING METHOD

BACKGROUND OF THE INVENTION

1. Field of the Invention

This invention relates to a discharging method and a hot-cathode type small fluorescent lamp using said discharging method.

2. Description of the Prior Art

A cold-cathode type small fluorescent lamp as a backlight of a liquid crystal display unit has been heretofore well known.

In the conventional cold-cathode type small fluorescent lamp filament-like electrodes are provided on opposite ends of a glass tube, and a high voltage is applied to said electrodes to discharge. Since a high voltage has to be used, a DC—DC converter is required, resulting in a problem of greater cost. In addition, there is a problem in that noises are generated in peripheral devices due to the presence of the converter.

SUMMARY OF THE INVENTION

It is an object of this invention to provide a discharging method and a hot-cathode type small fluorescent lamp in which a light emission of high luminance can be easily attained by a direct current of low voltage without using a DC—DC converter for conversion of high voltage which is high in price and generates noises in the peripheral devices.

It is a further object of this invention to provide a discharging method and a hot-cathode type small fluorescent lamp which can prevent a so-called cataphoresis phenomenon by which a service life of a negative electrode unilaterally emitting electrons is prolonged and a luminance is lowered as it moves away from the negative electrode with the passage of discharge or lighting time, and a long tubular one can be put to practical use.

DETAILED DESCRIPTION OF THE PREFERRED EMBODIMENTS

Figure 1:
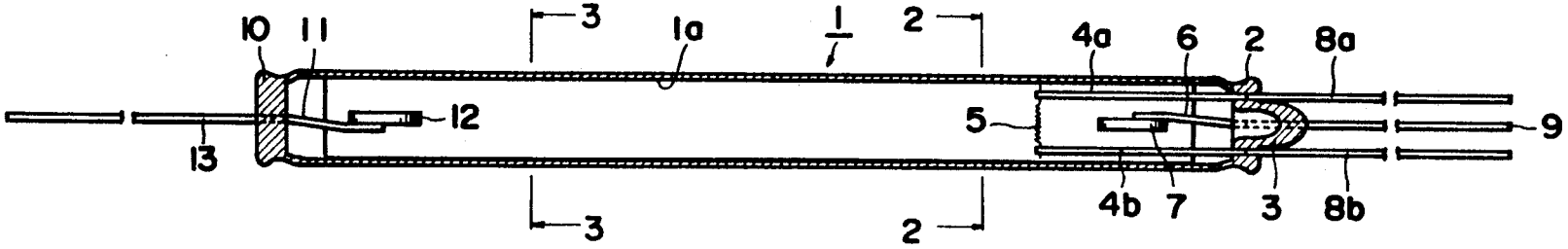
FIG. 1 is a front sectional view for explaining a discharging method and a small fluorescent lamp using the discharging method according to this invention.
Figure 3:
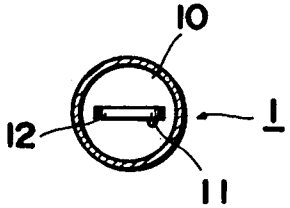
FIG. 3 is a sectional view taken on line 3—3 of FIG. 1.
Figure 2:
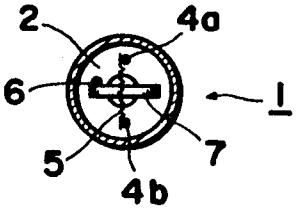
FIG. 2 is a sectional view taken on line 2—2 of FIG. 1.

The drawings show embodiments of this invention. In FIGS. 1 to 3, reference numeral 1 designates a glass tube having 7 mm of a bore diameter and approximately 70 mm of a length. A stem 2 having an exhaust pipe 3 is welded to one end of the glass tube 1, and a filament-like negative electrode 5 stretched between a pair of electrode support posts **4*a* and 4*b* is provided on the stem 2. An anode electrode 7 formed from a ring-like getter mounted on the extreme end of the electrode support post 6 is likewise provided on the stem 2, the anode electrode 7 being opposed to the negative electrode 5 in a perpendicular state in a slight spaced relation. The negative electrode 5 is of, for example, a double or triple coil, and the surface thereof is coated with a thermionic material formed of oxide principally comprising, for example, barium, strontium, and calcium. The negative electrode 5 and the anode electrode 7** constitute a first discharge portion though not shown by a reference numeral.

The electrode support posts **4*a*, 4*b* and 6 are connected to lead wires 8*a*, 8*b* and 9, respectively, within the stem 2, said lead wires 8*a*, 8*b* and 9 being led outside while airtightly extending through the stem 2**.

A stem 10 is welded to the other end of the glass tube 1, and the interior of the glass tube 1 constitutes a closed construction by the provision of the stem 10 and the aforementioned stem 2. Rare gas such as argon and a small amount of mercury are sealed into the glass tube, internal surface of which is coated with a fluorescent material la. An electrode support post 11 is provided on the stem 10, and an anode electrode 12 formed from a ring-like getter is mounted on the extreme end of the electrode support post 11. A second discharge portion though not indicated by a reference numeral is constituted between the anode electrode 12 and the negative electrode 5 of the aforementioned first discharge portion. The electrode support post 11 is connected to a lead wire 13 within the stem 10, said lead wire 13 being led outside extending through the stem 10 airtightly.

Figure 4:
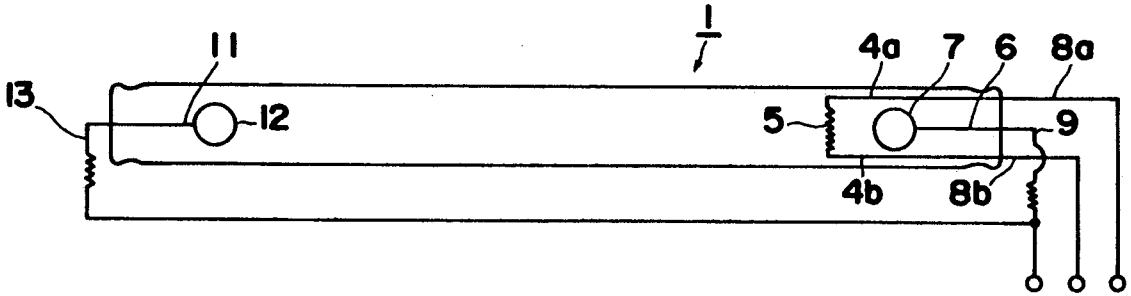
FIG. 4 is a discharge/lighting circuit view of the small fluorescent lamp shown in FIG. 1.

FIG. 4 shows an embodiment of a discharge/lighting circuit of the glass tube 1 having the aforementioned construction. According to the figure, when a DC voltage of 5 V is applied to the negative electrode 5 and a DC voltage of 12 V is applied to the positive electrodes 7 and 12, emission of thermion, i.e., preliminary charge, toward the positive electrode 7 opposed to the heated negative electrode 5 of the first discharge portion in a short spaced relation starts, and thereafter a main discharge occurs in the second discharge portion between the negative electrode 5 and the positive electrode 12 opposed in a long spaced relation. There is a slight deviation in time between the preliminary discharge and the main discharge of the first and second discharge portions, respectively. This deviation is so minute that human eyes can see it as if both the discharges are simultaneously started. The thermions generated by this discharge collide with mercury vapor to generate ultraviolet rays of 253.7 nm.

When the ultraviolet rays impinge upon the fluorescent material coated on the internal surface of the glass tube 1 as mentioned above, a visible light is generated. This visible light passes through the glass tube 1 and is emitted outside whereby the glass tube 1 forms a hot cathode type small fluorescent lamp.

When the main discharge occurs between the negative electrode 5 and the positive electrode 12 of the second discharge portion, a voltage need not be applied to the positive electrode 7. However, if this discharge is made to continue, there is a merit in that discharge and light emission at that portion can be secured. As for color of light, for example, in the case where well known halo potassium phosphate, for example, is used as a fluorescent material, pure white can be obtained as in a general fluorescent lamp, in which case, color temperature is 5,000 Kelvin. In the illustrated embodiment, the luminance is approximately 8,000 nit.

Luminescent color includes various colors depending on the kind of fluorescent materials to be coated on the glass tube 1.

Figure 5:
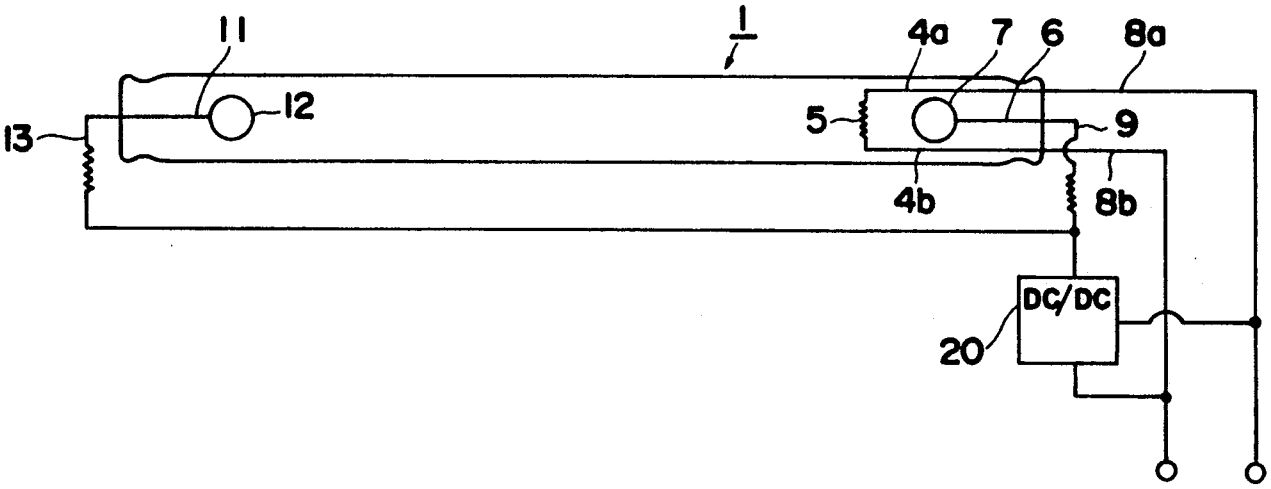
FIG. 5 is a lighting circuit view showing a further embodiment of the small fluorescent lamp shown in FIG. 1.

FIG. 5 shows a further embodiment of a lighting circuit. In the figure, a DC voltage of 5 V is used as a power source voltage, and 12 V or 24 V obtained by converting the 5 V DC voltage by use of a DC—DC converter 20 is applied to each of positive electrodes 7 and 12.

The DC—DC converter 20 used in this case may be of a simple construction because a low conversion voltage will suffice. This converter is much lower in manufacturing cost than that used for a conventional cold-cathode type. Noise rarely occurs.

Figure 6:
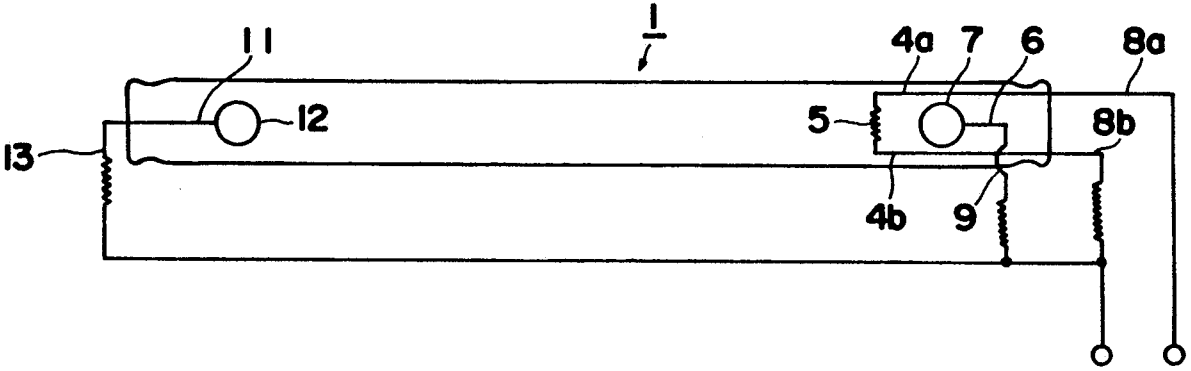
FIG. 6 is a discharge/lighting circuit view showing another embodiment of the small fluorescent lamp shown in FIG. 1.

FIG. 6 shows another embodiment of a lighting circuit. In the figure, a voltage of 24 V which is the same as that of the positive electrodes 7 and 12 is also applied to the negative electrode 5. Even if such an embodiment is carried out, the object of this invention can be achieved to obtain a small fluorescent lamp having a high luminance.

Figure 7:
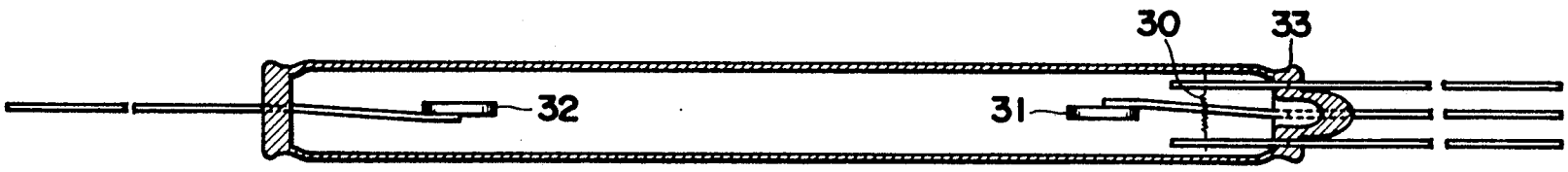
FIG. 7 is a front sectional view showing still another embodiment of the small fluorescent lamp.

FIG. 7 shows another embodiment of an electrode construction. In the figure, a positive electrode 31 corresponding to one negative electrode 30 is positioned opposite to the negative electrode 30 in the aforementioned embodiment. The other positive electrode 32 is the same as that of the previous embodiment.

In such an embodiment as described above, there is a merit in that assembling of the positive electrode 31 to a stem 33 becomes easy.

Figure 8:
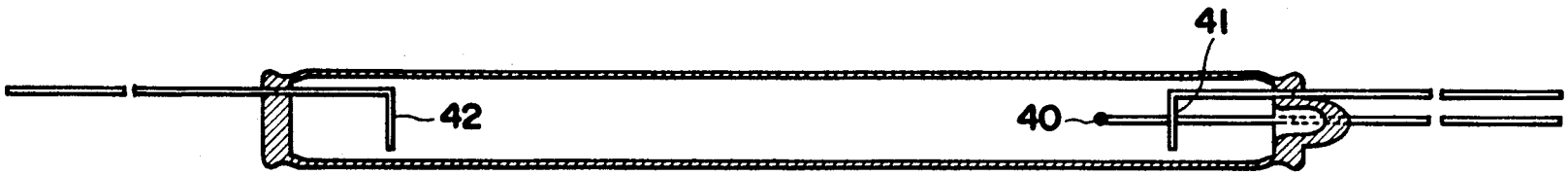
FIG. 8 is a front sectional view showing another embodiment of the small fluorescent lamp.

FIG. 8 shows still another embodiment of an electrode construction. In the figure, a positive electrode 41 corresponding to one negative electrode 40 is in the form of a rod, the positive electrode 41 being disposed perpendicularly in a slight spaced relation. A positive electrode 42 on the opposite side is also in the form of a rod.

In such an embodiment as described above, there is a merit in that a construction of the positive electrode is simple, and assembling is easy.

The rod-like positive electrode 41 itself can be of a getter, and a construction may be employed in which a getter is mounted to the extreme end of the positive electrode 41. Various modifications may be contemplated for the shape and construction of the positive electrode.

For the discharge/lighting circuits in the embodiments shown in FIGS. 7 and 8, those shown in FIGS. 4 to 6 may be suitably used.

Figure 9:
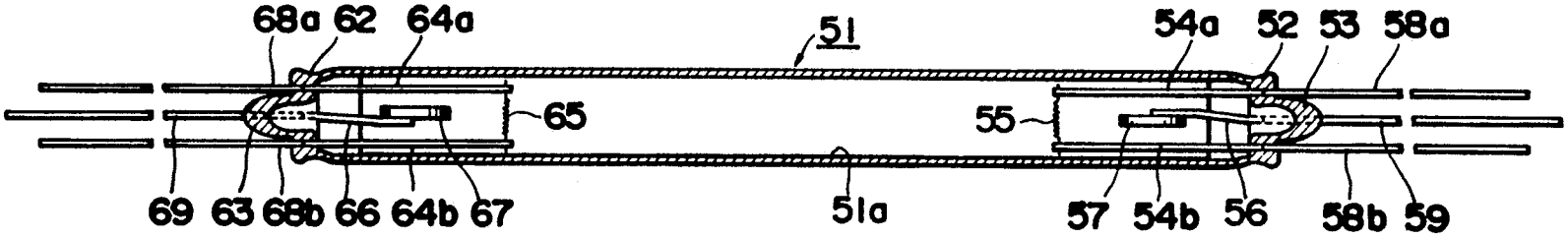
FIG. 9 is a front sectional view for explaining another embodiment of another discharging method and a small fluorescent lamp using the discharging method according to this invention.

FIG. 9 shows another embodiment of the discharging method and a small fluorescent lamp according to this invention. A stem 52 and an exhaust pipe 53 are provided on one end of a glass tube 51 which has the same construction as that of the previous embodiment. A filament-like negative electrode 55 stretched between a pair of electrode support posts **54*a* and 54*b* is provided on the stem 52. A positive electrode 57 formed from a ring-like getter mounted on the extreme end of an electrode support post 56 is likewise mounted on the stem 52, the positive electrode 57 being disposed perpendicularly in a slight spaced relation with respect to the negative electrode 55**.

Electrode support posts **54*a*, 54*b* and 56 are connected to lead wires, 58*a*, 58*b* and 59, respectively, within the stem 52, said lead wires 58*a*, 58*b* and 59 being led outside extending through the stem 52** in an air-tight manner.

A stem 62 and an exhaust pipe 63 are provided on the other end of the glass tube 51, and a filament-like negative electrode 65 stretched between a pair of electrode support posts **64*a* and 64*b* is provided on the stem 62. A positive electrode 67 formed from a ring-like getter mounted on the extreme end of an electrode support post 66 is likewise provided on the stem 62, the positive electrode 67 being disposed perpendicularly in a slight spaced relation with respect to the negative electrode 65. The negative electrode 65 is, for example, of a double or triple coil, on the surface of which is coated, for example, a thermionic emission material formed of oxide principally comprising barium, strontium, and calcium. Electrode support posts 64*a*, 64*b* and 66 are connected to lead wires, 68*a*, 68*b* and 69, respectively, within the stem 62, said lead wires 68*a*, 68*b* and 69 being led outside extending through the stem 62** in an air-tight manner.

The glass tube 51 is of a closed construction constituted by the stems 52 and 62 welded to opposite ends thereof, and rare gas, for example, such as argon, together with a small amount of mercury are sealed therein. This glass tube 51 is formed into a hot-cathode type small fluorescent lamp by coating a fluorescent material **51*a*** as in the aforementioned embodiment on the inner surface thereof in a well known manner.

Figure 10:
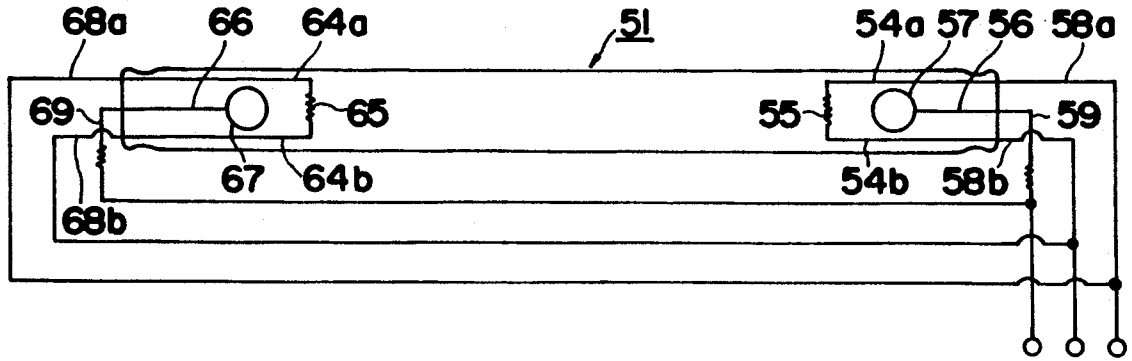
FIG. 10 is a discharge/lighting circuit view of the small fluorescent lamp shown in FIG. 9.

FIG. 10 shows an embodiment of a discharge/lighting circuit of the glass tube 51 having the construction shown in FIG. 9. In the figure, a DC voltage of 5 V is applied to negative electrodes 55 and 65, and a DC voltage of 12 V is applied to positive electrodes 57 and 67. Then, thermion is first emitted from the heated negative electrodes 55 and 65 toward the positive electrodes 57 and 67 opposed in a short spaced relation to start discharge. The thermion collides with mercury vapor to generate ultraviolet ray of 253.7 nm. If the fluorescent material is coated on the inner surface of the glass tube 51 as described above, the ultraviolet rays impinges upon the fluorescent lamp to generate a visible light whereby the whole glass tube 51 becomes emitted to form a hot-cathode type small fluorescent lamp. As for color of light, in the case where halo potassium phosphate is used as a fluorescent material as in the aforementioned embodiment, pure white can be obtained, in which case, color temperature is 5,000 Kelvin. In the illustrated embodiment, the luminance Is approximately 8,000 nit.

Figure 11:
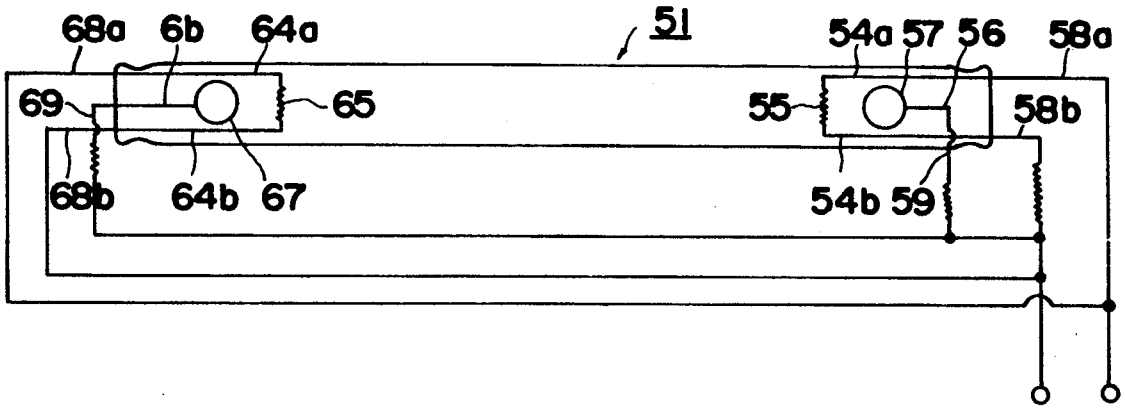
FIG. 11 is a discharge/lighting circuit view showing another embodiment of the small fluorescent lamp shown in FIG. 9.

FIG. 11 shows still another embodiment of a lighting circuit of a small fluorescent lamp shown in FIG. 9. In the figure, a voltage of 24 V which is the same as that of the positive electrodes 57 and 67 is applied to the negative electrodes 55 and 65. The object of this invention can be achieved by the embodiment as described. A small fluorescent lamp of higher luminance can be obtained.

Figure 12:
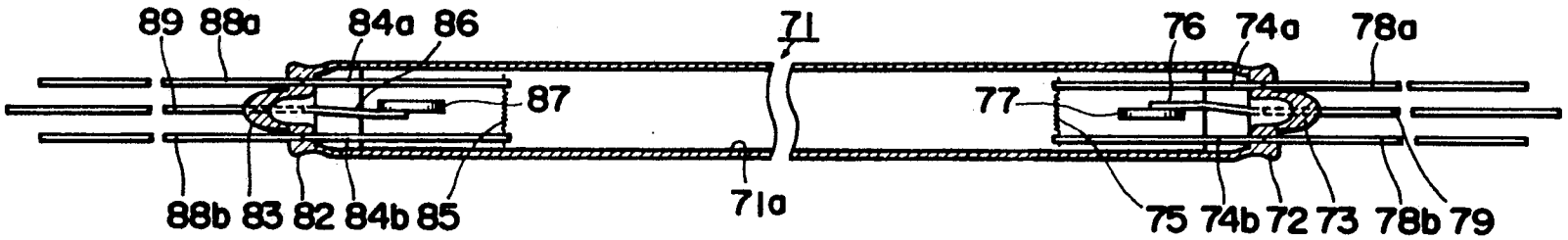
FIG. 12 is a front sectional view for explaining another discharging method and another small fluorescent lamp using said discharging method according to this invention.

FIG. 12 shows another embodiment of a discharging method and a small fluorescent lamp according to this invention. In the figure, reference numeral 71 designates an elongated glass tube having 7 mm of a bore diameter and approximately 150 mm of a length. A stem 72 and an exhaust pipe 73 are provided on one end of the glass tube 71, and a filament-like negative electrode 75 stretched between a pair of electrode support posts 74*a* and 74*b* is provided on the stem 72. A positive electrode 77 formed from a ring-like getter mounted on the extreme end of an electrode support post 76 is likewise provided on the stem 72, said positive electrode 77 being opposed perpendicularly in a slight spaced relation with respect to the negative electrode 75.

The electrode support posts 74*a*, 74*b* and 76 are connected to lead wires 78*a*, 78*b* and 79 within the stem 72, said lead wires 78*a*, 78*b* and 79 being led outside extending through the stem 72 in an air-tight manner.

A stem 82 and an exhaust pipe 83 are provided on the other end of the glass pipe 71, and a filament-like negative electrode 85 stretched between a pair of electrode support posts 84*a* and 84*b* is provided on the stem 82. A positive electrode 87 formed from a ring-like getter mounted on the extreme end of an electrode support post 86 is likewise provided on the stem 82, said positive electrode 87 being opposed perpendicularly in a slight spaced relation with respect to the negative electrode 85. The mounting position of the positive electrodes 77, 87 and the negative electrodes 75, 85 may be reversed to that of the embodiment and is not limited to that of the embodiment.

The electrode support posts 84*a*, 84*b* and 86 are connected to lead wires 88*a*, 88*b* and 89 within the stem 82, said lead wires 88*a*, 88*b* and 89 being led outside extending through the stem 82 in an air-tight manner.

The glass tube 71 has a closed construction constituted by the stems 72 and 82 welded to the opposite ends thereof, and rare gas, for example, such as argon together with a small amount of mercury are sealed therein. This glass tube 71 is formed into a fluorescent lamp by coating a fluorescent material 71*a* as in the aforementioned embodiment on the inner surface thereof as shown.

Figure 13:
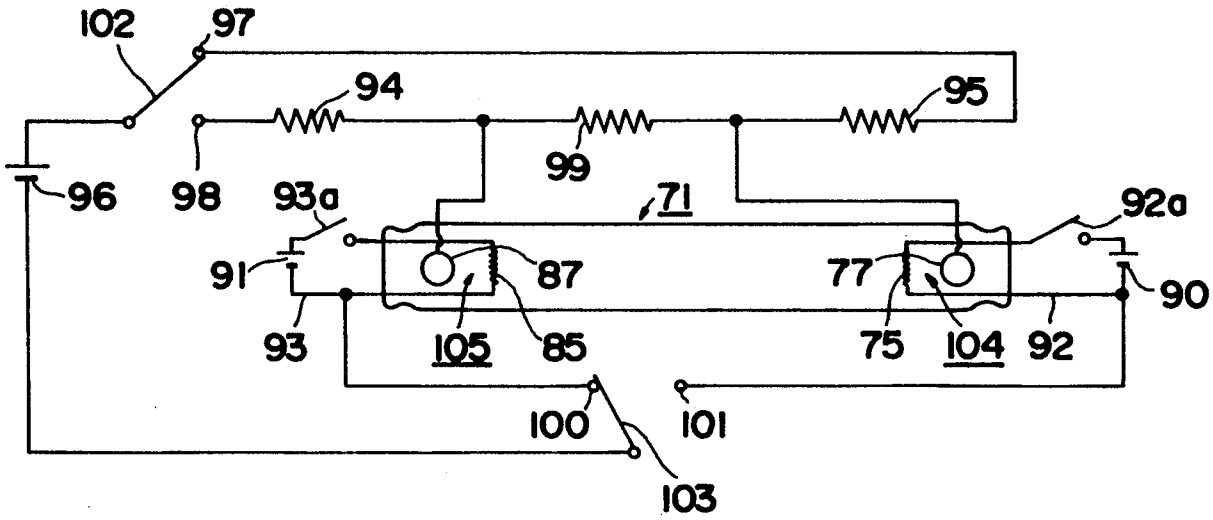
FIG. 13 is a lighting circuit view of the small fluorescent lamp shown in FIG. 12.

FIG. 13 explains a discharge/lighting circuit of the glass tube 71 having the aforementioned construction. In the figure, during the discharge/lighting, negative electrodes 75 and 85 are applied with a DC voltage through series power source circuits 92 and 93 through DC power sources 90 and 91 so that the negative electrodes 75 and 85 may be heated.

Reference numerals 92*a* and 93*a* designate switches for opening and closing the DC power source circuits 92 and 93. In the present invention, even if the switches 92*a* and 93*a* are not provided, no inconvenience in operation occurs However, when the switches 92*a* and 93*a* are provided, even if the negative electrodes 75 and 85 which cause the discharge to stop alternately as described later are not always heated, the switch of the DC power source circuit on the side in which discharge stops may be turned ON prior to switching to heat the negative electrodes, thus providing the merit in that a consumption power can be saved.

Next, the positive electrodes 77 and 87 are connected to terminals 97 and 98 with respect to the positive side of a DC power source 96 through resistors 94 and 95, respectively, and the positive electrodes 77 and 87 are connected through a resistor 99. On the other hand, the negative sides of the DC power source circuits 92 and 93 for heating the negative electrodes 75 and 85 are connected to terminals 100 and 101 with respect to the negative side of the power source 96. Reference numerals 102 and 103 designate switches which are simultaneously switched automatically and in a given period or by an external signal. In the embodiment, there is shown a mechanical switch including the switches 92*a* and 93*a*, which are shown merely for explanation. Of course, various other switching circuits can be used. It is desired that in the case where the discharge or lighting is continuously conducted for a long period of time, switching of said switch is automatically carried out every predetermined time as in the embodiment described later. However, an occurrence of cataphoresis phenomenon may be found by carrying out detection of a variation of current and voltage or detection by optical means provided in the neighbourhood of opposite ends of the glass tube. In the case where use is made in a state where discharge and lighting are Intermittently repeated prior to occurrence of cataphoresis phenomenon, switching may be made by repetition of the discharge and lighting.

In short, it is suffice that the discharge portion may be switched prior to occurrence of cataphoresis phenomenon or prior to occurrence of unilateral consumption of the negative electrodes of the discharge portion. The invention according to this embodiment may be applied to a glass tube having a short length and is not limited to a glass tube having a long length.

As shown in FIG. 13, in a state where the switches 102 and 103 are turned ON on the side of the terminals 97 and 100, thermion is emitted from the negative electrode 75 of 104 of the first discharge portion toward the positive electrode 77 to start preliminary discharge. Consecutively, thermion is emitted toward the negative electrode 75 of the first discharge portion 104 and the positive electrode 87 of the other second discharge portion 105 to start main discharge. The preliminary discharge and the main discharge occur without little occurrence of deviation in time, and human eyes can see it as if both the discharges are simultaneously carried out. The thermion collides with mercury vapor to generate ultraviolet rays of 253.7 nm. In the case where the glass tube 71 Is not coated with a fluorescent material, the ultraviolet rays are emitted outside as they are.

In the case where the inner surface of the glass tube 71 is coated pith a fluorescent material as in the aforementioned embodiment, the ultraviolet rays impinge upon the fluorescent material to generate a visible light whereby the glass tube 71 is formed into a hot-cathode small fluorescent lamp. As for the color of the light, in the case where halo potassium phosphate is used as a fluorescent material, pure white can be obtained, in which case, color temperature is 5,000 Kelvin. In the illustrated embodiment, the luminance is approximately 8,000 nit.

When one negative electrode is unilaterally consumed after passage of a given period of time or the switches 102 and 103 are switched to the terminals 98 and 101 side prior to occurrence of cataphoresis phenomenon, the discharge from the negative electrode 75 of the first discharge portion 104 toward the positive electrodes 77 and 87 so far made is cut, and the preliminary discharge from the negative electrode 85 of the second discharge portion 105 to the positive electrode 87 is conducted and then the main discharge from the negative electrode 85 toward the positive electrode 77 of the first discharge portion 104 occurs. The first and second discharge portions 104 and 105 alternately repeatedly conduct their discharge as the switches 102 and 103 are switched after passage of a given period of time. The switching of the discharge as the switches 102 and 103 are switched momentarily occurs if he negative electrodes 75 and 85 are heated in advance. Human eyes cannot sense such switching and can see it as if normal discharge is continuously effected.

Incidentally, switching time of the switches for preventing cataphoresis phenomenon may be about two hours for the case of a glass tube whose diameter and length are 7 mm and 150 mm, respectively, as mentioned above. In the case where switching of the switches is made merely for preventing consumption of the negative electrode, the aforesaid switching time may be naturally longer than that mentioned above.

Figure 14:
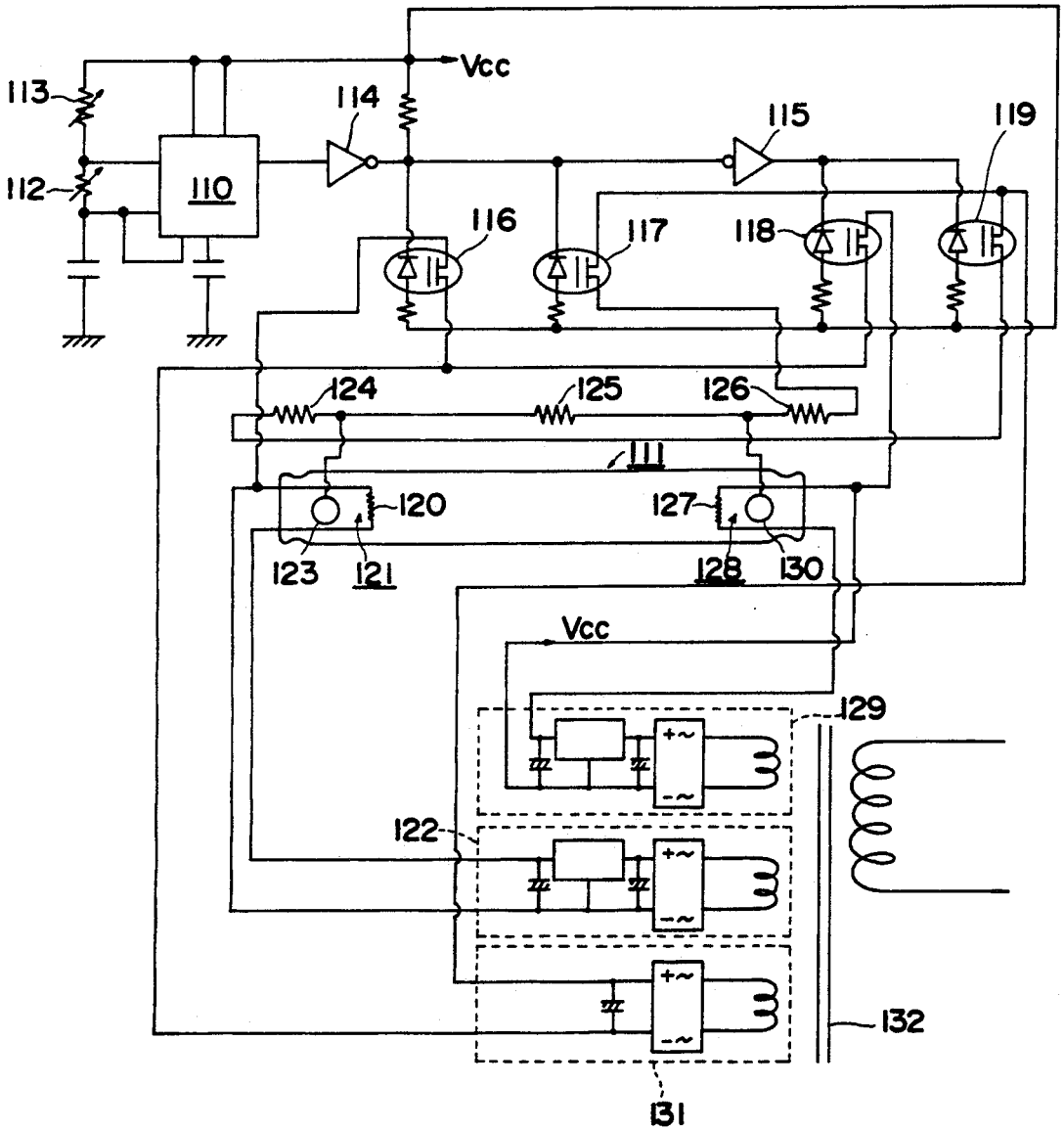
FIG. 14 is a lighting drive circuit view showing still another embodiment of a small fluorscent lamp.

FIG. 14 shows another embodiment of a lighting drive circuit. In the figure, reference numeral 110 denotes a pulse generator, which generates a pulse for controlling the switching of the discharge portion of the glass tube 111. A period of the pulse and duty ratio can be adjusted by variable resistors 112 and 113. Reference numeral 114 designates an inverter for inverting an output pulse of the pulse generator 110, 115 an inverter for inverting an output of the inverter 114, 116 and 117 photomoth relays controlled by the output of the inverter 114, and 118 and 119 photomoth relays controlled by the output of the inverter 115.

Reference numeral 120 designates a negative electrode of a first discharge portion 121, the negative electrode being heated by a power source circuit 122. Reference numeral 123 designates a positive electrode arranged opposedly close to the negative electrode 120 of the first discharge portion 121, the positive electrode 123 being connected to a connection point between resistor 124 and resistor 125 in a series circuit comprising the resistor 124, the resistor 125 and a resistor 126. Reference numeral 127 designates a negative electrode of a second discharge portion 128, the negative electrode 127 being heated by a power source circuit 129. Reference numeral 130 designates a positive electrode arranged opposedly close to the negative electrode 127 of the second discharge portion 128, the positive electrode 130 being connected to a connection point between the resitor 125 and resistor 126. A terminal of the resistor 126 on the side of the resistor 125 is connected to a positive side of the power source circuit 131 through the photomoth relay 117. A terminal of the resistor 124 on the side of the resistor 125 is also connected to a positive side of the power source circuit 131 through the photomoth relay 119. A photomoth relay 116 is connected between the negative eletrode 120 of the first discharge portion 121 of the glass tube 111 and the negative side of the power source circuit 131, and the photomoth relay 118 is connected between the negative electrode 127 of the second discharge portion 128 and the negative side of the power source circuit 131. Reference numeral 132 designates a transformer for the power source circuits 122, 129 and 131.

The operation will now be described. When the power source is closed, the negative electrodes 120 and 127 are heated by the power source circuits 122 and 129, and the output of the pulse generator 110 is "high" whereas the output of the inverter 114 is "low". That is, the photomoth relays 116 and 117 are turned on. The output of the inverter 114 is "high", and therefore the photomoth relays 118 and 119 are turned off.

The photomoth relay 116 is turned on whereby the negative electrode 120 of the first discharge portion 121 of the glass tube 111 assumes a state where the former is connected to the negative side of the power source circuit 131. The photomoth relay 117 is turned on whereby the positive electrode 130 of the second discharge portion 128 assumes a state where the positive electrode 130 of the second discharge portion is connected to the positive side of the power source circuit 131 through resistor 126, and the positive electrode 123 of the first discharge portion 121 assumes a state where the positive electrode 123 is connected to the positive side of the power source circuit 131 through a series circuit comprising the resistors 125 and 126. First, the preliminary discharge occurs between the positive electrode 123 of the first discharge portion 121 and the negative electrode 120. This triggerred the main discharge between the positive electrode 130 of the second discharge portion 128 and the negative electrode 120 of the first discharge portion 121. Thermions emitted by the preliminary discharge and the main discharge collide with mercury vapor to generate ultraviolet rays as mentioned above. The ultravoilet rays are emitted externally of the glass tube 111. In the case where a fluorescent material is coated on the inner surface of the glass tube 111 as mentioned above, the ultraviolet rays impinge upon the fluorescent material to generate a visible light, and the glass tube 111 is formed into a hot-cathode type small fluorescent lamp.

Next, when the pulse generated from the pulse generator 110 after passage of a predetermined time is changed from "high" to "low", the output of the inverter 114 is changed from "low" to "high", as a result of which the photomoth relays 116 and 117 are turned off so as not to apply a voltage between the negative electrode 120 and the positive electrode 123 of the first discharge portion 121 and the positive electrode 130 of the second discharge portion. Accordingly, no discharge occurs therebetween.

On the other hand, the output of the inverter 115 is changed from "high" to "low" as the inverter 114 inverts, and the photomoth relays 118 and 119 are turned on. The photomoth relay 118 is turned on whereby the negative electrode 127 of the second discharge portion 128 of the glass tube 111 assumes a state where it is connected to the negative side of the power source circuit 131. The photomoth relay 119 is turned on whereby the positive electrode 123 of the first discharge portion 121 of the glass tube 111 is connected to the positive side of the power source circuit 131 through the resistor 124, and the postive electrdoe 130 of the second discharge portion 128 assumes a state where the positive electrode 130 is connected to the positive side of the power source circuit 131 through a series circuit comprising the resistors 125 and 126.

Then, first, the preliminary discharge occurs between the positive electrode 130 of the second discharge portion 128 and the negative electrode 127 of the second discharge portion 128. This triggered the main discharge between the positive electrode 123 of the first discharge portion 121 and the negative electrode 127 of the second discahrge portion 128. Thereby, switching of the electrodes by which discharge occurs is completed.

Thereafter, the aforementioned operation is repeated, and the first and second discharge portions alternately repeat their discharge at predetermined intervals. This switching of discharge momentarily occurs since the negative electrode is preheated in advance. Therefore, human eyes can see it as it the glass tube 111 continuously discharges or lights.

What is claimed is:

1. A discharging method using a lamp having a first discharge portion with a filament-like negative electrode and a first positive electrode arranged at a short spaced distance from the negative electrode and on one end of a glass tube having a closed construction, the glass tube being in the form of a long tube and being filled with a small amount of mercury together with inert gas, and a second discharge portion at an opposite end of the glass tube and having only one second positive electrode arranged at the opposite end of the glass tube at a long spaced distance from the negative electrode of the first discharge portion, the method comprising the steps of: applying a DC voltage to said electrodes of said first discahrge portion so that said first discharge portion is first preliminarily discharged; and thereafter, applying a DC voltage between said negative electrode of first discharge portion and the second positive electrode of said second discharge portion so that said second discharge portion is mainly discharged.

2. A small fluorescent lamp, comprising:

a glass tube filled with a small amount of mercury and a rate gas, said glass tube being coated on its inner surface with a fluorescent coating;

a filament-like negative electrode arranged at one end of said glass tube and said glass tube, and coated with a thermionic emissive material;

a first positive electrode at said one end of said glass tube and in said glass tube; said first positive electrode being at a short spaced distance from said negative electrode; and a single second positive electrode at an opposite end of said glass tube and in said glass tube, at a long spaced distance from said negative electrode.

3. A small fluorescent lamp according to claim 2, wherein the first positive electrode is simultaneously formed of a getter.

4. A small fluorescent lamp according to claim 2, including means connected to said electrodes so that a voltage applied to the negative electrode is lower than a voltage applied to said first and second positive electrodes.

5. A small fluorescent lamp according to claim 3, wherein the getter is in the form of a ring which is arranged perpendicularly to the negative electrode.

6. A small fluorescent lamp according to claim 2, wherein the positive electrodes are each in the form of a rod.

7. A discharging method using a lamp having a pair of discharge portions each including a filament-like negative electrode and a positive electrode arranged at a slight spaced distance from said negative electrode, said pair of discharge portions being on opposite ends, respectively, of a glass tube having a closed construction in the form of a long tube filled with a small amount of mercury together and an inert gas, the method comprising;

applying a DC voltage between the negative electrode of said one discharge portion and the positive electrode of the other discahrge portion to form a first discharge;

alternately applying a DC voltage between the negative electrode of said other discharge portion and positive electrode to said one discharge portion to form second discharge, the alternate first and second discharges being formed using drive means for applying the DC voltages.

8. A method according to claim 7 including alternately applying the DC voltages for the first and second discharges, at a selected interval.

9. A method according to claim 8 including, during each interval, placing the negative electrode in the discharge portion which is not being subjected to a discharge, in a standby condition during which the negative electrode is pre-heated.

10. A method according to claim 9 including preheating the negative electrode in the discharge portion which is not being subjected to discharge, immediately before initiating discharge in the discharge portion, at the end of each interval.

11. A small fluorescent lamp comprising a glass tube filled with a small amount of mercury and a rate gas, said glass tube being coated on its inner surface with a fluorescent coating, a pair of discharge portions wherein a filament-like negative electrode coated with a thermionic emissive material and a positive electrode are arranged opposedly in a slightly spaced relation on opposite ends, respectively, of said glass tube, a lighting circuit for alternately applying a DC voltage between each of said positive electrodes and one of said negative electrodes, wherein said lighting circuit comprises a pair of DC power source circuits for individually applying a voltage to each of said negative electrodes, a DC source circuit for applying a voltage to said positive electrodes, four switches provided in each of said DC power source circuits and actuated in a paired relation, a pulse generator, and a pair of inverters for actuating said switches in a paired relation by high level and low level signal of said pulse generator.

12. A small fluorescent lamp according to claim 11, wherein the switches comprise photomoth relays.

* * * * *